US007036349B2

(12) United States Patent
Inch

(10) Patent No.: US 7,036,349 B2
(45) Date of Patent: May 2, 2006

(54) SCALLOP OUTPUT SHAFT TOOLS

(75) Inventor: Gordon R. Inch, Fort Gratiot, MI (US)

(73) Assignee: American Axle & Manufacturing, Inc., Detroit, MI (US)

( * ) Notice: Subject to any disclaimer, the term of this patent is extended or adjusted under 35 U.S.C. 154(b) by 386 days.

(21) Appl. No.: 10/644,679

(22) Filed: Aug. 20, 2003

(65) Prior Publication Data

US 2005/0039514 A1 Feb. 24, 2005

(51) Int. Cl.
*B21J 13/02* (2006.01)

(52) U.S. Cl. ..... 72/359; 72/354.6; 72/355.4; 72/356; 72/404

(58) Field of Classification Search ..... 72/359, 72/256, 284, 285, 353.6, 354.2, 358, 357, 72/353.2, 354.6, 354.8, 355.2, 355.4, 355.6, 72/356, 404; 29/893.34
See application file for complete search history.

(56) References Cited

U.S. PATENT DOCUMENTS

| | | | | |
|---|---|---|---|---|
| 3,759,080 | A * | 9/1973 | Sugahara et al. | 72/356 |
| 4,287,747 | A * | 9/1981 | Koshimaru et al. | 72/358 |
| 4,733,550 | A * | 3/1988 | Williams | 72/348 |
| 4,939,829 | A * | 7/1990 | Maki et al. | 29/893.34 |
| 4,967,584 | A * | 11/1990 | Sato et al. | 72/356 |
| 5,813,272 | A * | 9/1998 | Gomi | 72/354.8 |
| 6,332,347 | B1 * | 12/2001 | Gomi | 72/355.6 |

* cited by examiner

*Primary Examiner*—Dmitry Suhol
(74) *Attorney, Agent, or Firm*—Harness, Dickey & Pierce P.L.C.

(57) ABSTRACT

A die for forming a work-piece having a complex geometry includes a die insert having an interior surface that defines a first portion of the complex geometry and a retainer ring that selectively engages the die insert. The retainer ring includes a circumferential interior surface that defines a second portion of the complex geometry. A punch insert that is slidably disposed in the retainer ring and includes a surface that defines a third portion of the complex geometry.

22 Claims, 8 Drawing Sheets

SCALLOP OUTPUT SHAFT TOOLS

FIELD OF THE INVENTION

The present invention relates to metal forming, and more particularly to upset forging.

BACKGROUND OF THE INVENTION

Upset forging is a metal forming process by which metal stock, typically a length of metal bar, is worked to form an unfinished piece. The length of bar is worked to increase a cross-sectional area of a portion or all of the bar stock. The unfinished work piece is then machined (e.g., turning, grinding and the like) and/or treated (e.g., heat treated) to produce a finished product.

An upsetter is a machine with horizontally moving dies that upset forge the metal stock. The metal stock is heated to between 1750 and 2000° F. and then formed in the upsetter. Typical upsetters implement multiple dies in a multi-pass process. For example, the first few passes gradually work the metal stock to a near complete form and the final pass works the stock into the complete form, providing the unfinished work piece.

Some unfinished work pieces require complex geometries to be formed. Unfortunately, traditional upsetters are unable to form these complex geometries. As a result, such unfinished work pieces are formed using alternative metal forming processes. The alternative metal forming processes are more expensive and have longer cycle times than upset forging.

SUMMARY OF THE INVENTION

Accordingly, the present invention provides a die for forming a work-piece having a complex geometry. The die includes a die insert having an interior surface that defines a first portion of the complex geometry and a retainer ring that selectively engages the die insert. The retainer ring includes a circumferential interior surface that defines a second portion of the complex geometry. A punch insert that is slidably disposed in the retainer ring and includes a surface that defines a third portion of the complex geometry.

In one feature, the die further includes an adaptor that couples the retainer ring and the punch insert to a forging machine. A first series of resilient members couple the retainer ring and the adaptor. A second series of resilient members couple the punch insert and the adaptor.

In still another feature, a stopper extends into the retainer ring to limit sliding movement of the pass insert relative to the retainer ring. The punch insert includes a tab formed therein. The tab selectively engages the stopper to limit sliding motion of the punch insert relative to the retainer ring.

In yet another feature, the die insert includes a relief that slidably receives an end of said retainer ring.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
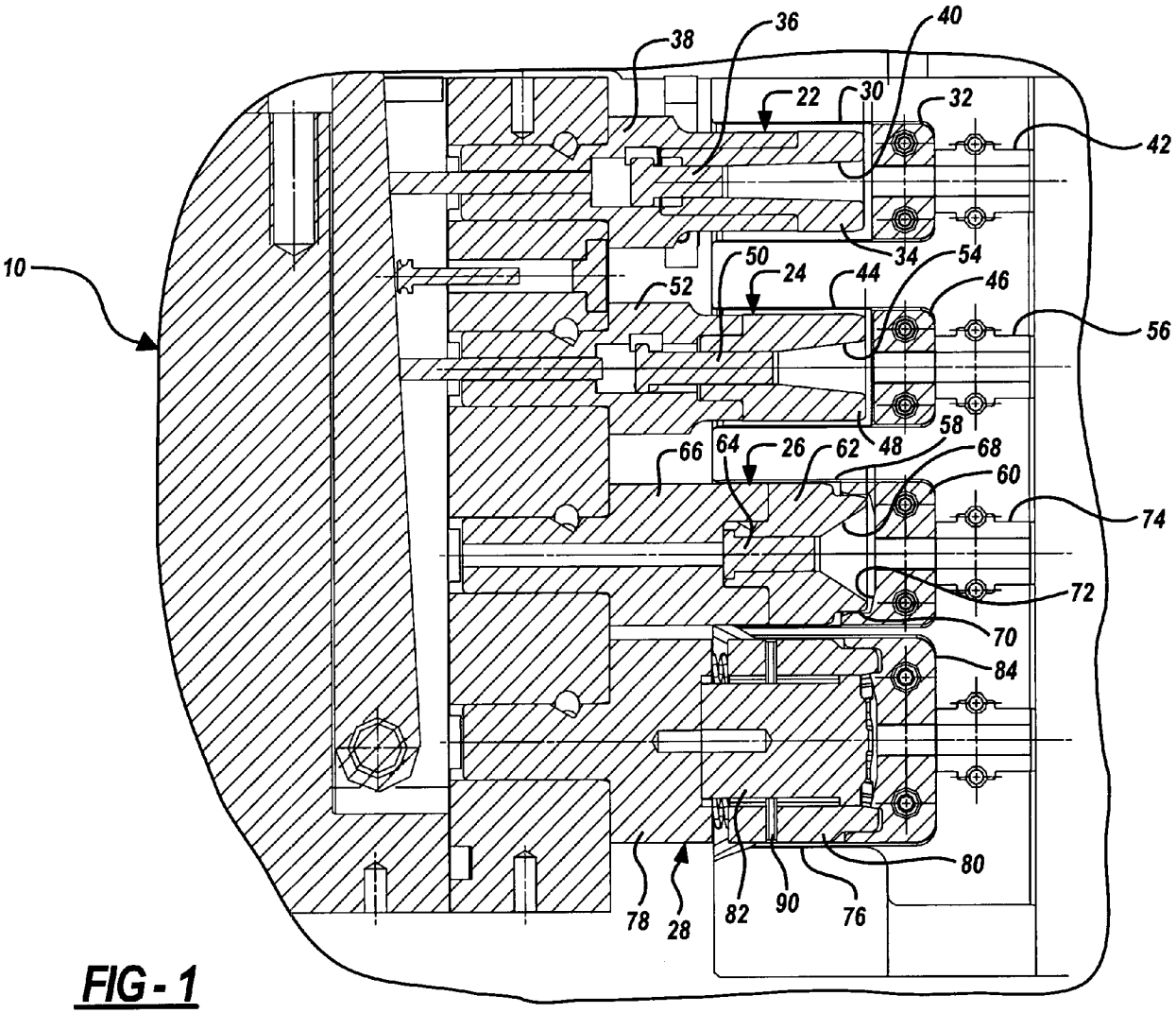
FIG. 1 is a cross-sectional view of a portion of a four-pass upsetter according to the present invention.
Figure 2A:
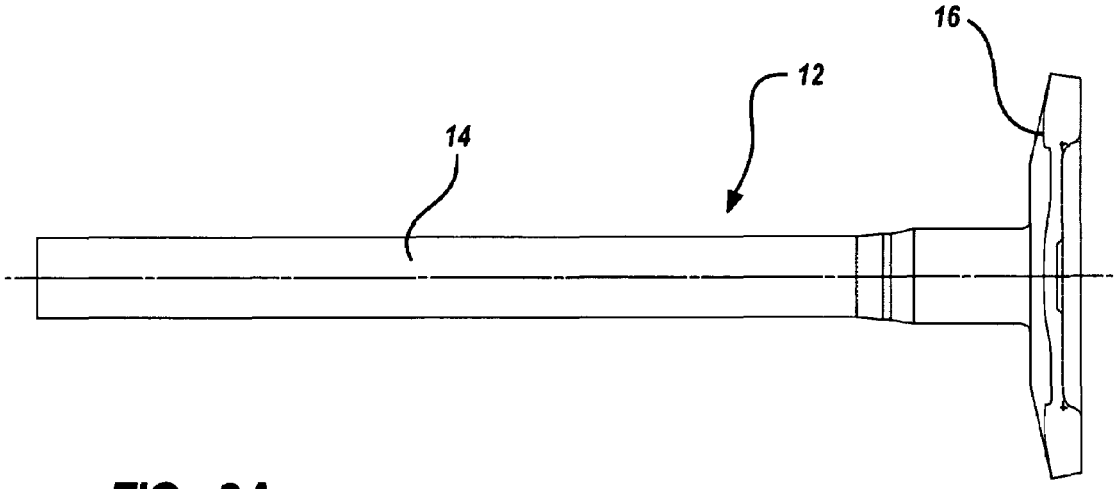
FIG. 2A is a side view of an exemplary work piece formed in the upsetter.
Figure 2B:
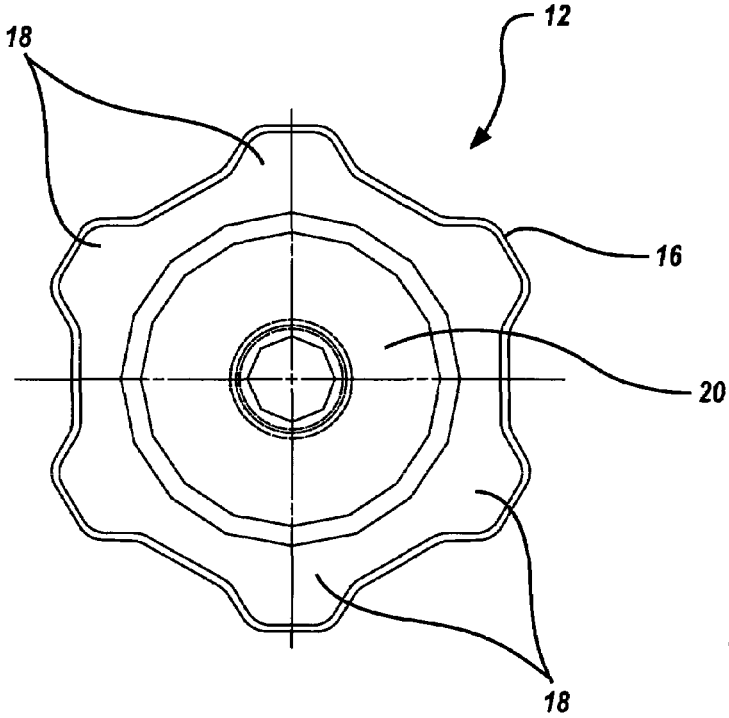
FIG. 2B is a front view detailing an end geometry of the exemplary work piece of FIG. 2A.
Figure 3:
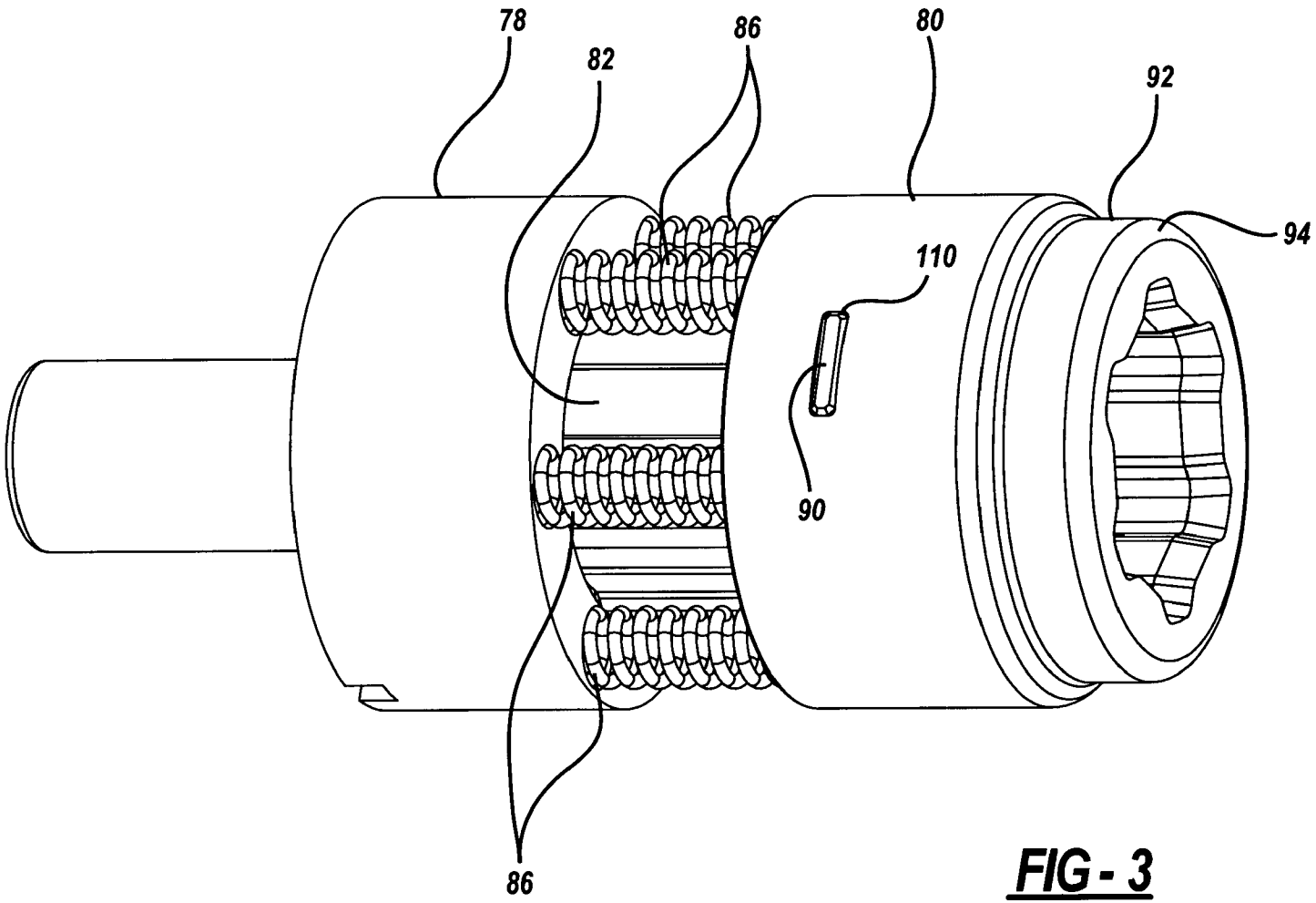
FIG. 3 is a perspective view of a finish pass die of the four-pass upsetter of FIG. 1.
Figure 4:
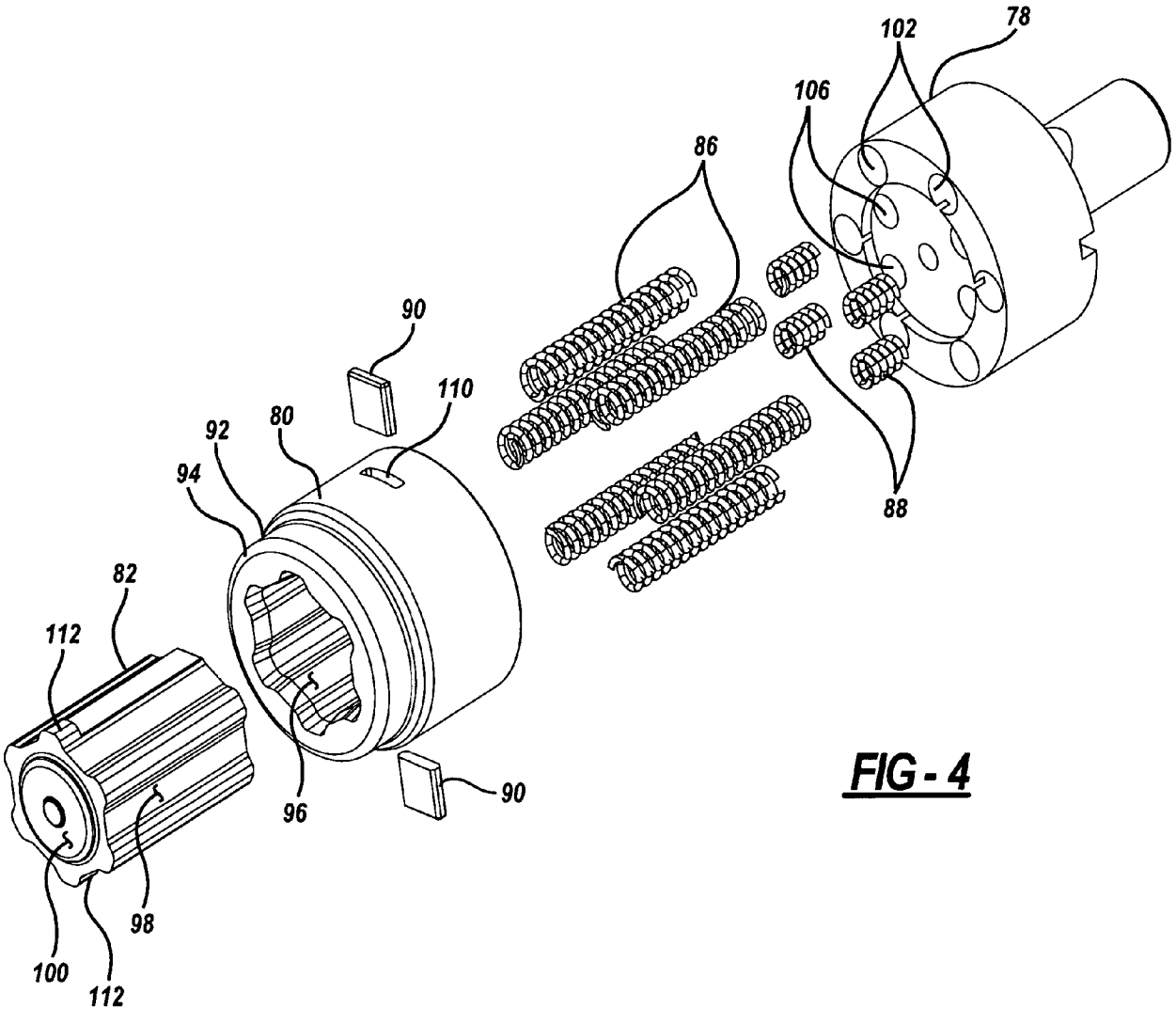
FIG. 4 is an exploded view detailing components of the finish pass die.
Figure 5:
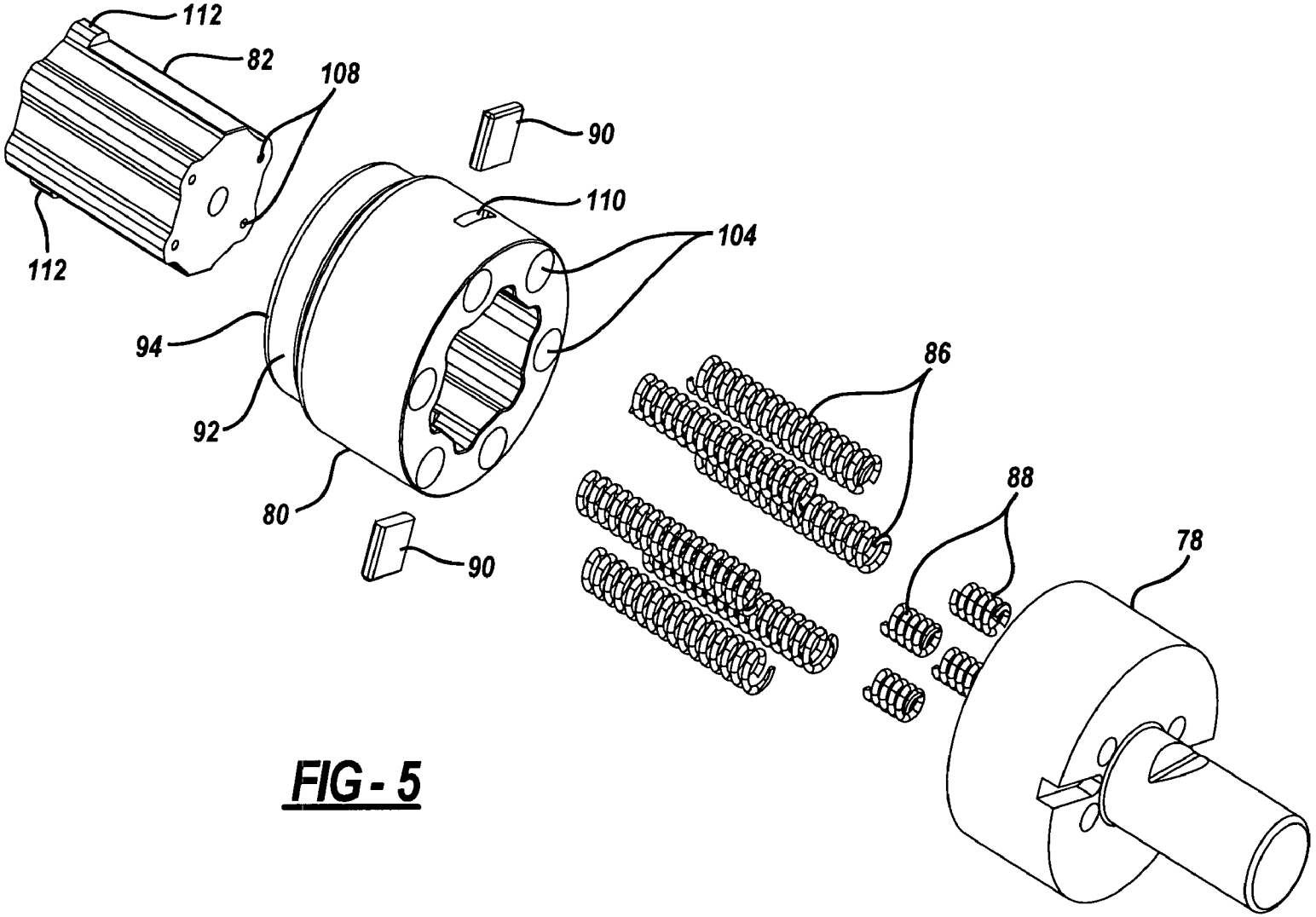
FIG. 5 is another exploded view of the finish pass die.
Figure 6:
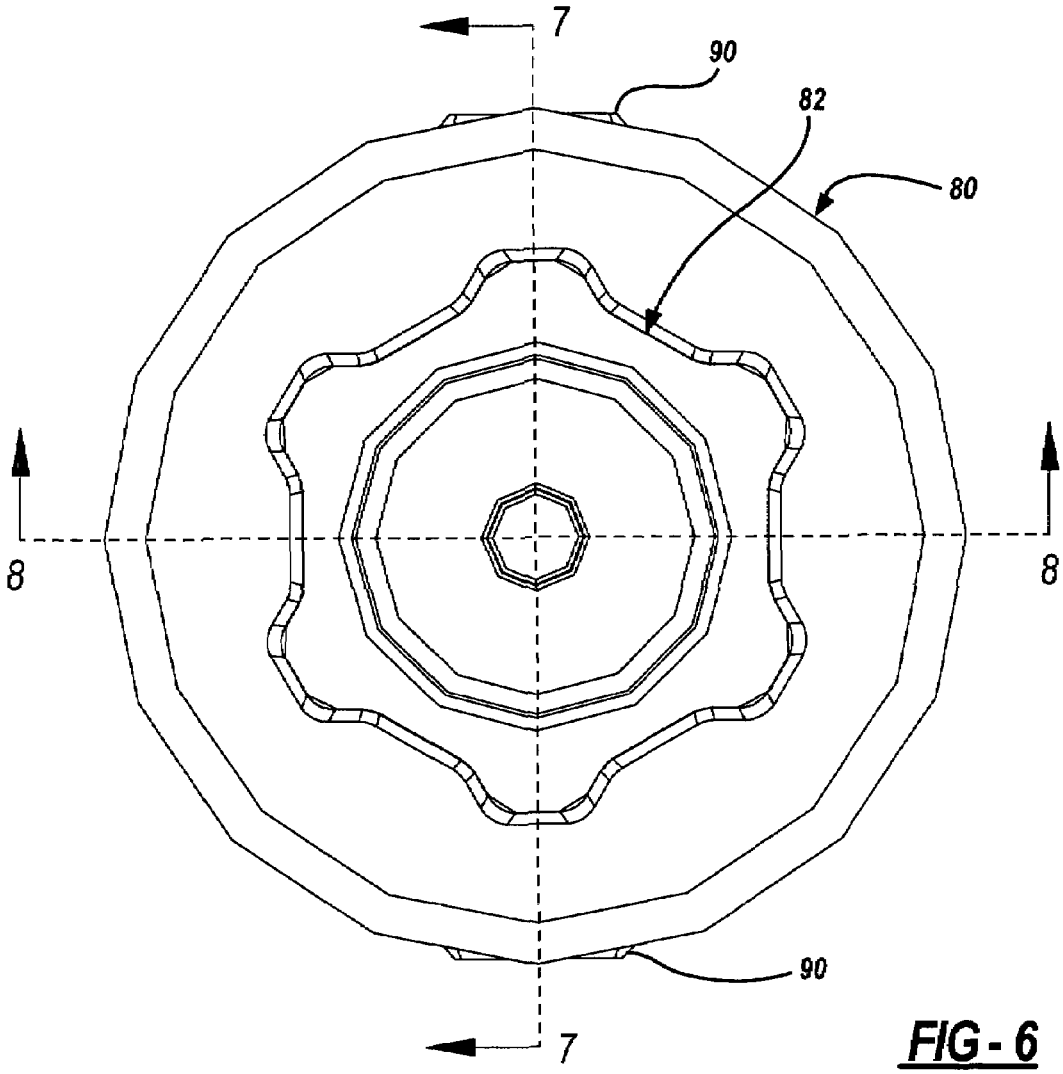
FIG. 6 is a top view of the finish pass die.
Figure 7:
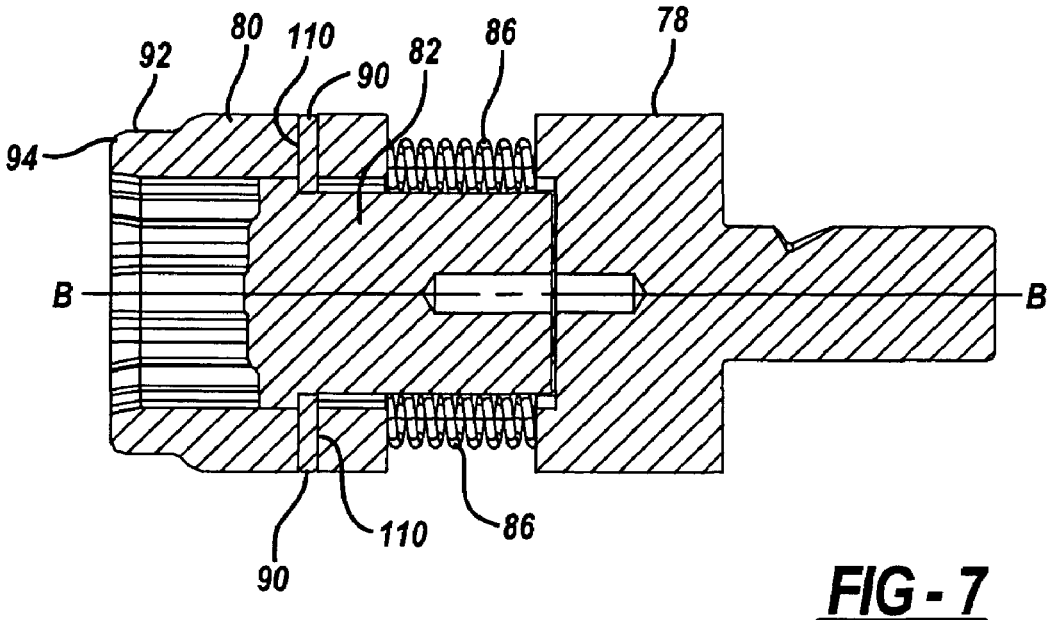
FIG. 7 is a cross-sectional view of the finish pass die along line 7—7 of FIG. 6.
Figure 8:
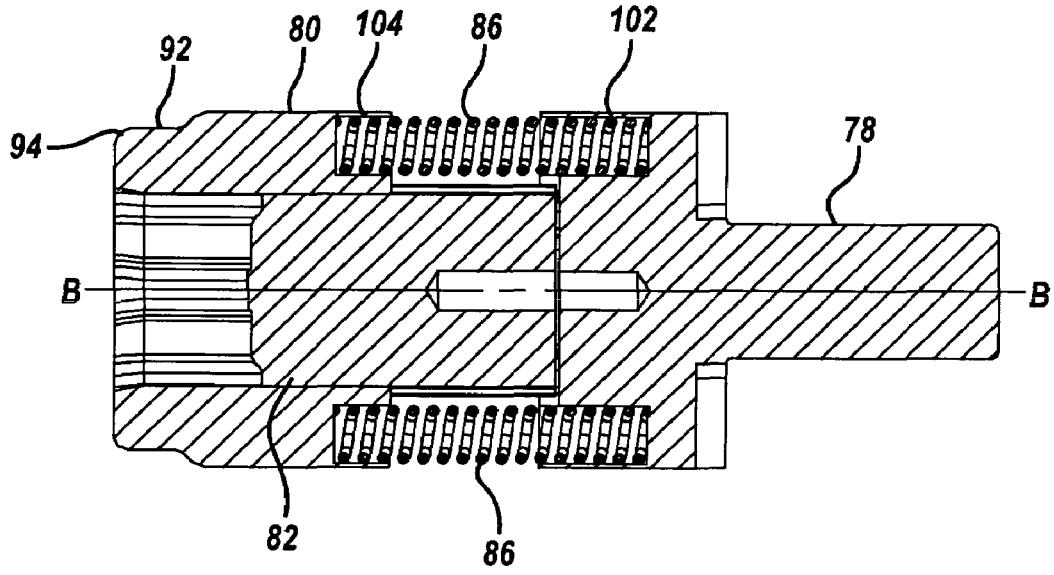
FIG. 8 is a cross-sectional view of the finish pass die along line 8—8 of FIG. 6.
Figure 9:
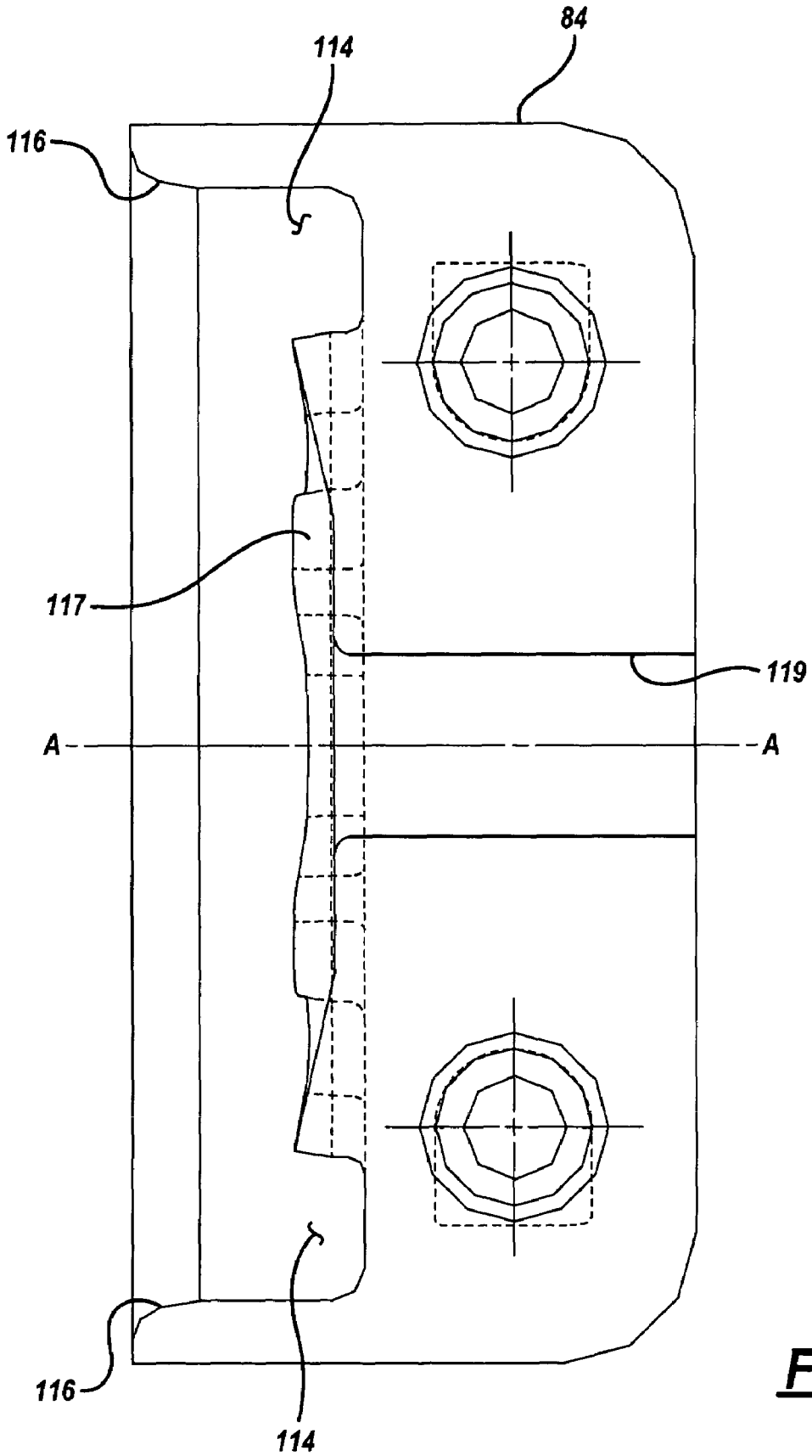
FIG. 9 is a detailed cross-sectional view of a finish pass die insert according to the present invention.

Referring now to FIG. 1, cross-sectional view of a portion of an upsetter 10 is shown. The upsetter 10 is a multi-pass upsetter having four passes. It is appreciated that the upsetter 10 can include more or fewer passes depending upon the requirements of a particular product. The upsetter 10 forms a piece of metal stock, in this case bar stock, into an unfinished work piece. An exemplary unfinished work piece 12, shown in FIGS. 2A and 2B, is indicative of a scallop output shaft that is used in a vehicular propeller shaft application. It is appreciated, however, that the upsetter 10 of the present invention can be used to form other unfinished work pieces formed with complex geometries.

The upsetter 10 forms the unfinished work piece 12 from metal bar stock (not shown). The exemplary unfinished work piece 12 (i.e., the scallop output shaft) includes a bar 14 and scallop end 16 formed on an end of the bar 14. The scallop end 16 includes a complex geometry formed of radially extending nodes 18 and a circular relief 20 formed in a back face.

Referring back to FIG. 1, the upsetter 10 includes a first pass die 22, a second pass die 24, a third pass die 26 and a finish pass die 28. The bar stock is gradually formed into the unfinished work piece 12 as it is moved from die to die. More particularly, the first, second and third pass dies 22,24,26 gradually displace the bar stock material to form a cone on an end of the bar stock. The final pass die 28 forges the conical end into the complex geometry. In the case of the scallop output shaft of FIGS. 2A and 2B, the final pass die forms the nodes 18 and reliefs 20 of the scallop end 16.

The first pass die 22 is located in a first pass cavity 30 of the upsetter 10 and includes a die insert 32, a punch insert 34, a knock-out pin 36 and an adaptor 38. The adaptor 38 interconnects the upsetter 10 and the first pass die 22 to enable the upsetter 10 to move the first pass die 22 horizontally for forging the bar stock. The punch insert 34 includes a conical cavity 40 formed therein. The bar stock is placed through a sleeve 42 and extends into the first pass cavity 30 through the die insert 32. The first pass punch 34 is rammed toward the bar stock and the bar stock is forced into the conical cavity 40. The ramming force displaces the bar stock material such that it assumes a conical form defined by the conical cavity 40. The knock-out pin 36 is used to knock the semi-formed bar stock from the punch insert 34.

The second pass die 24 is located in a second pass cavity 44 of the upsetter 10 and includes a die insert 46, a punch insert 48, a knock-out pin 50 and an adaptor 52. The adaptor 52 interconnects the upsetter 10 and the second pass die 24 to enable the upsetter 10 to move the second pass die 24 horizontally for forging the bar stock. The punch insert 48 includes a conical cavity 54 that is slightly shorter and has a more extreme wall angle then the conical cavity 40 of the first pass die 22. The semi-formed bar stock from the first pass die 22 is placed through a sleeve 56 and extends into the second pass cavity 44 through the die insert 46. The second pass punch 48 is rammed toward the semi-formed bar stock, which is forced into the conical cavity 54. The ramming force further displaces the bar stock material such that it assumes a conical form defined by the conical cavity 54. The knock-out pin 50 is used to knock the semi-formed bar stock from the punch insert 48.

The third pass die 26 is located in a third pass cavity 58 of the upsetter 10 and includes a die insert 60, a punch insert 62, a knock-out pin 64 and an adaptor 66. The adaptor 66 interconnects the upsetter 10 and the third pass die 26 to enable the upsetter 10 to move the third pass die 26 horizontally for forging the bar stock. The punch insert 62 includes a conical cavity 68 that is even shorter and has an even more extreme wall angle then the conical cavity 54 of the second pass die 24. The punch insert 62 further includes a stepped end 70 defining an exterior circumferential surface. The die insert 60 includes a circular cavity 72 defined by a contoured face and an inner circumferential surface. Upon actuation of the third pass die 26, the punch insert 62 is received into the die insert 60, whereby the outer circumferential surface slides against the inner circumferential surface.

The semi-formed bar stock from the first and second pass dies 22,24 is placed through a sleeve 74 and extends into the third pass cavity 58 through the die insert 60. The third pass punch insert 70 is rammed toward the semi-formed bar stock, which is forced into the conical cavity 68 and the circular cavity 72. The ramming force further displaces the bar stock material such that it assumes a conical form defined by the conical cavity 68 and the circular cavity 72. The knock-out pin 64 is used to knock the semi-formed bar stock from the punch insert 70.

Referring now to FIGS. 1 and 3 through 9, the finish pass die 28 will be discussed in detail. The finish pass die 28 seats within a finish pass cavity 76 of the upsetter 10 and includes an adaptor 78, a retainer ring 80, a finish punch insert 82, a die insert 84, a first series of resilient members 86, a second series of resilient members 88 and stoppers 90. The adaptor 78 interconnects the upsetter 10 and the retainer ring 80 and the finish punch insert 82 to enable the upsetter 10 to actuate the finish pass die 28 for further forging of the bar stock. The finish punch insert 82 is slidably disposed within the retainer ring 80.

The retainer ring 80 is attached to the adaptor 78 via the first series of resilient members 86 and includes a stepped end 92. The stepped end 92 includes a chamfer 94. The finish punch insert 82 is attached to the adaptor 78 via the second series of resilient members 88 and is slidably disposed within the retainer ring 80. An inside surface 96 of the retainer ring is contoured to form a cavity and define the nodes 18 of the scallop end 16 of the unfinished piece 12. An exterior surface 98 of the finish punch insert is contoured to conform to the inside surface 96 of the retainer ring 80. The finish punch insert 82 is slidable within the cavity of the retainer ring 80. A face 100 of the finish punch insert 82 is contoured to define the reliefs 20 in the back face of the scallop end 16.

The adaptor 78 includes a series of seats 102 (see FIG. 4) within which ends of the first series of resilient members 86 seat. Similarly, the retainer ring 80 includes a series of seats 104 (see FIG. 5) within which opposite ends of the first series of resilient members 86 seat. The adaptor 78 also includes a second series of seats 106 within which ends of the second series of resilient members 88 seat. The finish pass insert 82 includes bores 108 against which opposite ends of the second series of resilient members 88 seat.

The stoppers 90 extend into the cavity through bores 110 in the retainer ring 80. The stoppers 90 are fixed in position by hard welding. The finish pass insert 82 includes radially extending tabs 112 that selectively contact the stoppers 90. The tabs 112 slide within the contoured surface 96 formed in the retainer ring 82. The stopper/tab interface prevents the finish pass insert 82 from being pulled out of the retainer ring 80.

The die insert 84 includes a relief 114 that receives the stepped end 92 of the retainer ring 82 as the finish pass die 28 forms the unfinished piece (see FIG. 1). The relief 114 includes a chamfer 116. The die insert also includes a contoured surface 117 that displaces the bar stock material to further define the complex geometry and a passage 119 through which the bar 14 extends. As the finish pass die 28 is actuated to form the unfinished piece, the retainer ring 82 is received into the relief 114. The chambers 94,116 enable proper alignment of the retainer ring 82 and die insert 84. The first and second series of resilient members 86,88 enable the retainer ring 80 and finish punch insert 82 to float relative to the die insert 84. As a result, the retainer ring 80 and finish punch insert 82 are able to be properly aligned by the die insert 84 as the finish pass die 28 is actuated.

When disengaged from the die insert 84, the retainer ring 80 and finish punch insert 82 float relative to the die insert 84. More specifically, with reference to FIGS. 7 through 9, the die insert 84 includes a central axis A. The retainer ring 80 and finish punch insert 82 include a central axis B. In the disengaged position, axis B radially floats relative to axis A. That is to say, axis B can be offset from axis A. In the engaged position, where the retainer ring 80 is received into the die insert 84, axes A and B are aligned.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A die for forming a work-piece having a complex geometry, comprising:

a die insert having a first axis and an interior surface that defines a first portion of said complex geometry;

a retainer ring that selectively engages said die insert and includes a circumferential interior surface that defines a second portion of said complex geometry; and a punch insert that is slidably disposed in said retainer and movable along a second axis, wherein the punch insert is coupled to an adapter via a resilient member to allow said punch insert to be movable relative to the die insert to a position where the second axis is offset from the first axis and another position where the second axis is aligned with the first axis, the punch insert including a surface that defines a third portion of said complex geometry.

2. The die of claim 1 wherein said adaptor couples said retainer ring and said punch insert to a forging machine.

3. The die of claim 2 further comprising a first series of resilient members that couple said retainer ring and said adaptor.

4. The die of claim 3 further comprising a second series of resilient members, including said resilient member, that couple said punch insert and said adaptor.

5. The die of claim 1 further comprising a stopper that extends into said retainer ring to limit sliding movement of said punch insert relative to said retainer ring.

6. The die of claim 5 wherein said punch insert includes a tab formed therein, said tab selectively engaging said stopper to limit sliding motion of said punch insert relative to said retainer ring.

7. The die of claim 1 wherein said die insert includes a relief that slidably receives an end of said retainer ring.

8. A finish pass die that forms a complex geometry into a partially forged work-piece, comprising:

a die insert having an interior surface that defines a first face of said complex geometry;

a retainer ring coupled to a resilient member, said retainer ring being axially movable relative to said die insert along an axis of said die insert between an engaged position and a disengaged position, wherein in said disengaged position said resilient member allows said retainer ring to radiallty float relative to said axis of said die insert and in said engaged position said retainer ring is aligned with said axis and engages said die insert; and a finish punch insert that is slidably disposed in said retainer ring and that includes a surface that defines a second face of said complex geometry and when said retainer ring is in said engaged position, said partially forged work-piece is sandwiched between said interior surface of said die insert and said surface of said finish punch insert to form said complex geometry.

9. The finish pass die of claim 8 wherein said die insert and includes a circumferential interior surface that defines a circumferential surface of said complex geometry.

10. The finish pass die of claim 8 further comprising an adaptor that couples said retainer ring and said finish punch insert to a forging machine.

11. The finish pass die of claim 10 further comprising a first series of resilient members, including said resilient member, that couple said retainer ring and said adaptor.

12. The finish pass die of claim 11 further comprising a second series of resilient members that couple said finish punch insert and said adaptor.

13. The finish pass die of claim 8 further comprising a stopper that extends into said retainer ring to limit sliding movement of said finish punch insert relative to said retainer ring.

14. The finish pass die of claim 13 wherein said finish punch insert includes a tab formed therein, said tab selectively engaging said stopper to limit sliding motion of said finish punch insert relative to said retainer ring.

15. The finish pass die of claim 8 wherein said die insert includes a relief that slidably receives an end of said retainer ring.

16. A multi-pass forging machine that forms a complex geometry into a work-piece, comprising:

a first pass die that partially forms said work-piece; and a finish pass die that forms said complex geometry in said partially formed work-piece, said finish pass die comprising:

a die insert having an axis and an interior surface that defines a first portion of said complex geometry;

a retainer ring that selectively engages said die insert and includes a circumferential interior surface that defines a second portion of said complex geometry;

a resilient member copied to said retainer ring, said resilient member allowing said retainer ring to be movable relative to said die insert along said axis as well as in a direction substantially perpendicular to said axis; and a finish punch insert that is slidably disposed in said retainer ring and that includes a surface that defines a third portion of said complex geometry.

17. The multi-pass forging machine of claim 16 further comprising an adaptor that couples said retainer ring and said finish punch insert to a forging machine.

18. The multi-pass forging machine of claim 17 further comprising a first series of resilient members, including said resilient member, that couple said retainer ring and said adaptor.

19. The multi-pass forging machine of claim 18 further comprising a second series of resilient members that couple said finish punch insert and said adaptor.

20. The multi-pass forging machine of claim 16 further comprising a stopper that extends into said retainer ring to limit sliding movement of said finish punch insert relative to said retainer ring.

21. The multi-pass forging machine of claim 20 wherein said finish punch insert includes a tab formed therein, said tab selectively engaging said stopper to limit sliding motion of said finish punch insert relative to said retainer ring.

22. The multi-pass forging machine of claim 16 wherein said die insert includes a relief that slidably receives an end of said retainer ring.

* * * * *